US012514343B2

(12) United States Patent
Kato et al.

(10) Patent No.: US 12,514,343 B2
(45) Date of Patent: Jan. 6, 2026

(54) FIXTURE FOR ELECTRONIC DEVICE

(71) Applicant: TOYOTA JIDOSHA KABUSHIKI KAISHA, Toyota (JP)

(72) Inventors: Takahiro Kato, Numazu (JP); Kazuyuki Yokota, Toyota (JP); Mitsuru Kawasaki, Tokyo (JP); Kazuyoshi Kamekawa, Kyoto (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 67 days.

(21) Appl. No.: 18/442,499

(22) Filed: Feb. 15, 2024

(65) Prior Publication Data

US 2024/0415245 A1 Dec. 19, 2024

(30) Foreign Application Priority Data

Jun. 16, 2023 (JP) ..... 2023-098896

(51) Int. Cl.
*F16M 13/00* (2006.01)
*A44C 5/14* (2006.01)
*A44C 5/18* (2006.01)

(52) U.S. Cl.
CPC ..... *A44C 5/147* (2013.01); *A44C 5/18* (2013.01)

(58) Field of Classification Search
None
See application file for complete search history.

(56) References Cited

U.S. PATENT DOCUMENTS

| | | | | | |
|---|---|---|---|---|---|
| 4,571,199 | A * | 2/1986 | Murakami | G04B 47/04 | 446/73 |
| 5,657,298 | A * | 8/1997 | Choay | G04B 37/1413 | 368/300 |
| 9,004,329 | B2 * | 4/2015 | Hsieh | A44C 5/00 | 224/221 |
| 9,918,541 | B2 * | 3/2018 | Byun | G04G 17/08 | |
| 10,069,329 | B1 * | 9/2018 | Roberson | H02S 20/30 | |
| 10,537,134 | B1 * | 1/2020 | Xiao | A24F 15/18 | |
| D897,350 | S * | 9/2020 | Wang | D14/440 | |
| D897,867 | S * | 10/2020 | Wright | D10/30 | |
| 10,945,664 | B1 * | 3/2021 | Webb | A61B 5/0059 | |
| D960,893 | S * | 8/2022 | Zhou | D14/440 | |
| D974,215 | S * | 1/2023 | Zhou | D10/132 | |

(Continued)

FOREIGN PATENT DOCUMENTS

| | | | |
|---|---|---|---|
| JP | 11018125 A | * | 1/1999 |
| JP | H11-018125 A | | 1/1999 |

(Continued)

OTHER PUBLICATIONS

ALXDR iWatch case pendant, Internet [online], Amazon, Aug. 21, 2019, [Searched Oct. 1, 2025], Obtained <https://www.amazon.co.jp/dp/B07WWZSDSS >.

*Primary Examiner* — Steven M Marsh
(74) *Attorney, Agent, or Firm* — SoraIP, Inc.

(57) ABSTRACT

The fixture of the electronic device includes a frame-shaped main body part into which the electronic device is fitted, and an attachment member that attaches the main body part to a target part. An insertion port into which an electronic device can be inserted is formed in the main body portion. In a state in which the fixture is fixed to the target part, the insertion port is formed so as to open toward the target part.

3 Claims, 10 Drawing Sheets

(56) References Cited

U.S. PATENT DOCUMENTS

| | | | | |
|---|---|---|---|---|
| 2009/0196124 | A1* | 8/2009 | Mooring | G04B 37/005<br>368/204 |
| 2017/0248922 | A1* | 8/2017 | Hynecek | A45C 11/12 |
| 2020/0363773 | A1 | 11/2020 | Wang et al. | |

FOREIGN PATENT DOCUMENTS

| | | | |
|---|---|---|---|
| JP | 2011-501831 | A | 1/2011 |
| JP | 5550077 | B2 | 7/2014 |
| WO | 2009/033034 | A1 | 3/2009 |
| WO | 2016/038468 | A1 | 3/2016 |

* cited by examiner

FIXTURE FOR ELECTRONIC DEVICE

CROSS-REFERENCE TO RELATED APPLICATION

This application claims priority to Japanese Patent Application No. 2023-098896 filed on Jun. 16, 2023, incorporated herein by reference in its entirety.

BACKGROUND

1. Technical Field

The present disclosure relates to a fixture for an electronic device such as a wearable device.

2. Description of Related Art

In recent years, electronic devices such as wearable devices (hereinafter simply referred to as "electronic devices") have been utilized in various situations. Heretofore, fixtures for electronic devices have been proposed so that users can carry the electronic devices. For example, Japanese Unexamined Patent Application Publication (Translation of PCT Application) No. 2011-501831 (JP 2011-501831 A) discloses a wristband with a sleeve in which a universal serial bus (USB) device is to be inserted. Japanese Unexamined Patent Application Publication No. 11-18125 (JP 11-18125 A) discloses a belt holder to which a receiver can be attached.

SUMMARY

In the wristband disclosed in JP 2011-501831 A, it is assumed that the electronic device is attached to the wrist. Therefore, the degree of freedom is low in terms of changing the attachment to another part. In the belt holder disclosed in JP 11-18125 A, the receiver (electronic device) may fall from an open surface into which the receiver can be inserted in a state in which the belt holder is fixed to a belt.

An object of the present disclosure is to suppress limitation of a target part to which an electronic device can be attached, and to suppress a fall of the electronic device.

A fixture for an electronic device according to an aspect of the present disclosure includes

- a frame-shaped body into which the electronic device is to be fitted, and an attachment member configured to attach the body to a target part.
- The body has an insertion port into which the electronic device is insertable.
- In a state in which the fixture is fixed to the target part, the insertion port is open to the target part.

The body may include an annular frame, and a first side piece and a second side piece provided away from each other on the frame and facing each other.

- The first side piece and the second side piece may project in a projecting direction away from the frame.
- A distance between the first side piece and the second side piece may decrease in the projecting direction.

The frame may include a pair of long side portions and a pair of short side portions.

- The body may further include a first end piece provided on one of the short side portions, and a second end piece provided on the other of the short side portions and facing the first end piece.
- The first side piece may be provided on one of the long side portions.

- The second side piece may be provided on the other of the long side portions.
- The first end piece and the second end piece may project in the projecting direction.
- In the projecting direction, an end of the first side piece, an end of the second side piece, an end of the first end piece, and an end of the second end piece may be positioned on a virtual plane.

The attachment member may be provided at the end of the first end piece in the projecting direction, and project from the end of the first end piece away from the second end piece.

The second end piece may include an inner surface facing the first end piece. The inner surface may be provided closer to the first end piece in the projecting direction.

According to the present disclosure, it is possible to suppress the limitation of the target part to which the electronic device can be attached, and to suppress the fall of the electronic device.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
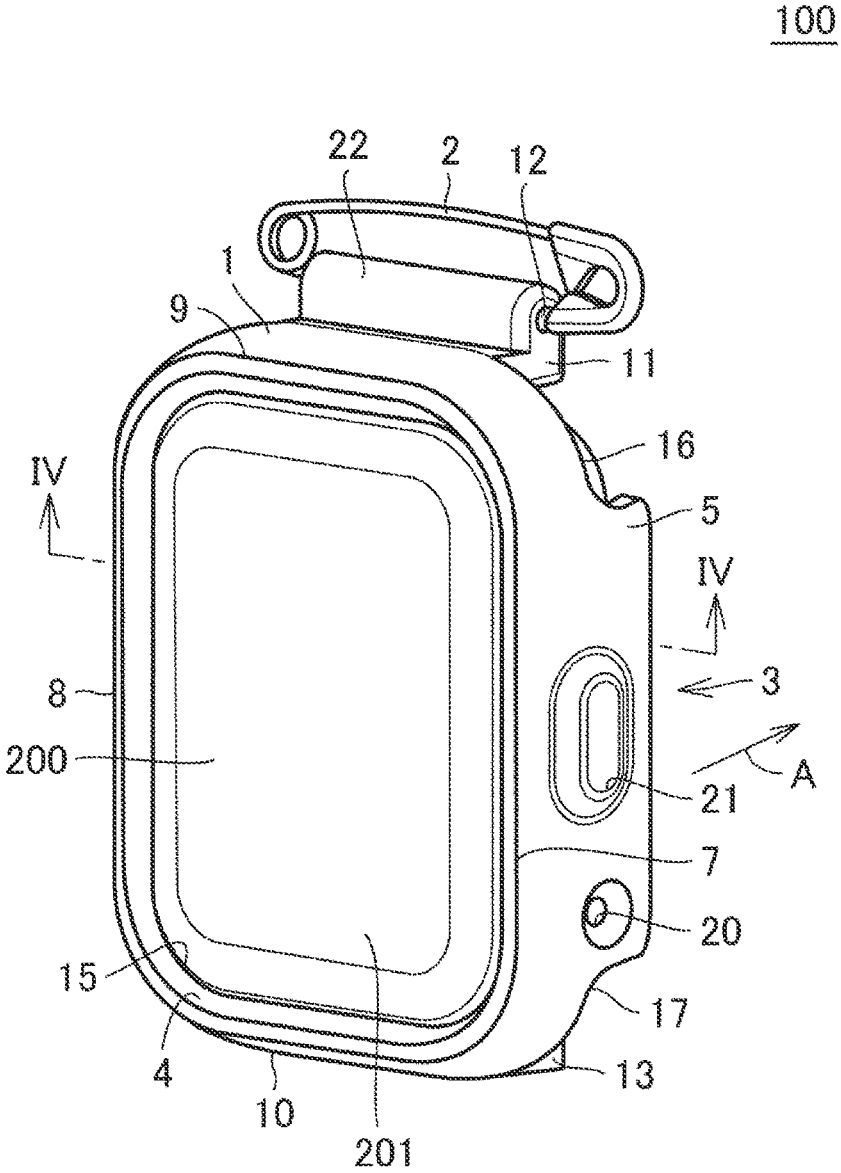
FIG. 1 is a first diagram illustrating a fixture of an electronic device according to a first embodiment.

Hereinafter, embodiments and modifications according to the present disclosure will be described with reference to the drawings. In the following description, the same components and components are denoted by the same reference numerals. Their names and functions are also the same. Therefore, a detailed description thereof will not be repeated. It should be noted that the embodiments and the modification examples described below may be selectively combined as appropriate.

First Embodiment

Figure 2:
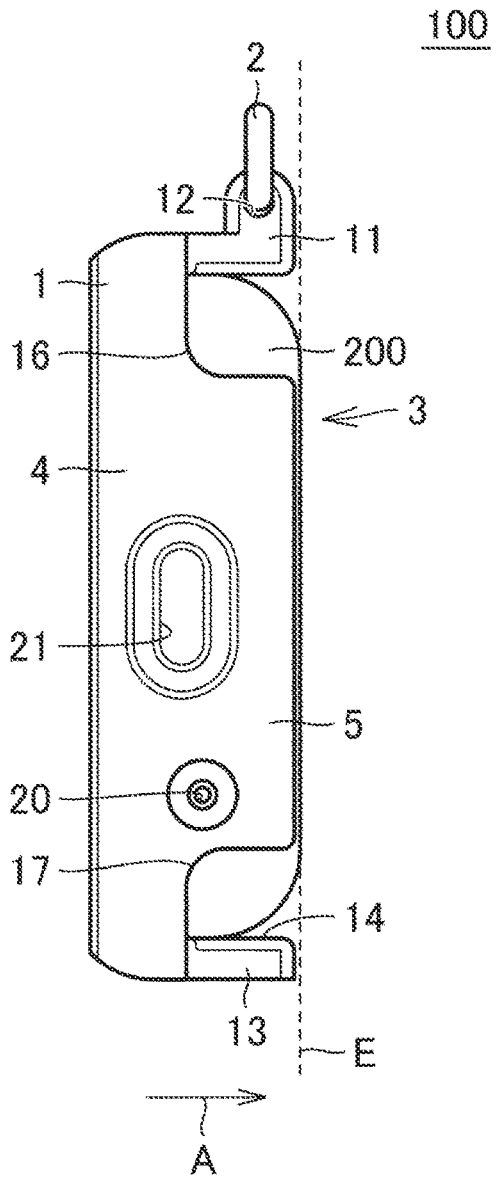
FIG. 2 is a second diagram illustrating a fixture of the electronic device according to the first embodiment.
Figure 3:
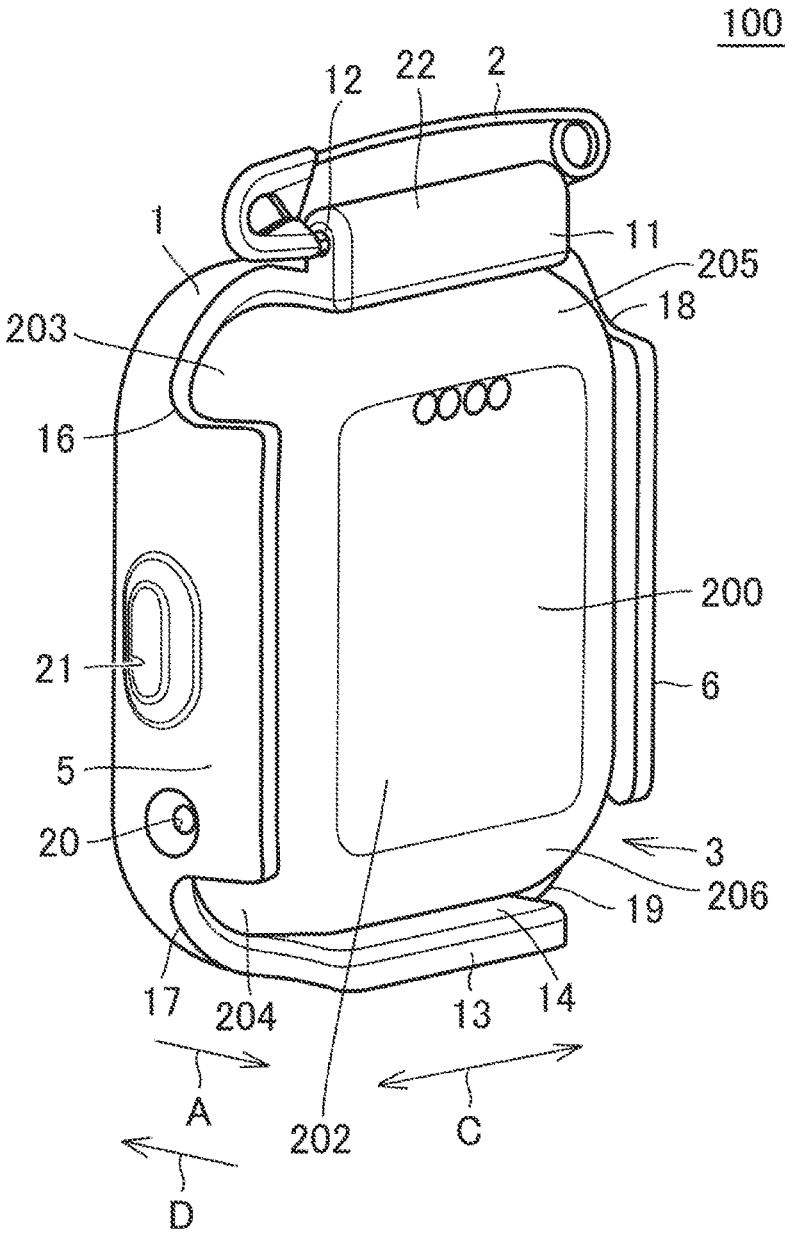
FIG. 3 is a third diagram illustrating a fixture of the electronic device according to the first embodiment.
Figure 4:
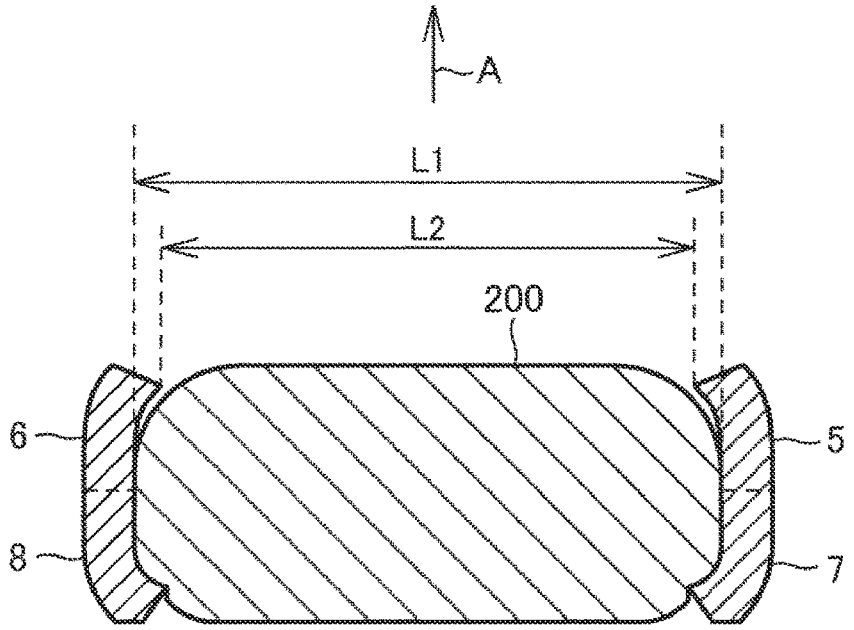
FIG. 4 is a cross-sectional view of the fixture of the electronic device according to the first embodiment taken along IV-IV shown in FIG. 1.

Referring to FIGS. 1 to 4, a fixture of an electronic device according to Embodiment 1 will be described. FIG. 1 is a first diagram illustrating a fixture of an electronic device according to a first embodiment; FIG. 2 is a second diagram illustrating a fixture of the electronic device according to the first embodiment; FIG. 3 is a third diagram illustrating a fixture of the electronic device according to the first embodiment; FIG. 4 is a cross-sectional view of the fixture of the electronic device according to the first embodiment taken along a IV-IV line shown in FIG. 1.

The fixture 100 according to the first embodiment is used to fix the electronic device 200 to a target part. In Embodiment 1, the target part is a site where the fastening needle 2 can be pierced (e.g., a site having a fabric portion such as a hat, clothing, or bag).

The fixture 100 includes a frame-shaped main body portion 1 into which the electronic device 200 is fitted, and a fastening needle 2 that attaches the main body portion 1 to a target part. The fastening needle 2 is an example of an "attachment member" in the present disclosure. The fixture 100 is fixed to the target part by piercing the fastening needle 2 to the target part. An insertion port 3 into which the electronic device 200 can be inserted is formed in the main body portion 1. The electronic device 200 is taken in and out from the insertion port 3. In a state in which the fixture 100 is fixed to the target part, the insertion port 3 is formed so as to open toward the target part. Therefore, when the fixture 100 into which the electronic device 200 is fitted is fixed to the target part, the drop of the electronic device 200 is suppressed by the target part.

The main body portion 1 may include an annular frame portion 4, a first side piece portion 5, a second side piece portion 6, a first end piece portion 11, and a second end piece portion 13. The frame portion 4 may include a long side portion 7, a long side portion 8, a short side portion 9, and a short side portion 10. The long side portion 7 and the long side portion 8 are examples of a "pair of long side portions" in the present disclosure. The short side portion 9 and the short side portion 10 are examples of a "pair of short side portions" in the present disclosure. The first side piece portion 5, the second side piece portion 6, the first end piece portion 11, and the second end piece portion 13 define an insertion port 3. The frame portion 4 may define the window portion 15 on the side facing the insertion port 3. In the window portion 15, a part of the electronic device 200 is exposed.

The first side piece portion 5 and the second side piece portion 6 are formed 5 so as to be spaced apart from each other and to face each other in the frame portion 4. More specifically, the first side piece portion 5 is formed on the long side portion 7. The second side piece portion 6 is formed on the long side portion 8. The first side piece portion 5 and the second side piece portion 6 protrude in the projecting direction A away from the frame portion 4. The projecting direction A indicates a direction from the frame portion 4 toward the target part in a state where the fixture 100 is fixed to the target part. When the electronic device 200 is inserted into the insertion port 3, the first side piece portion 5 and the second side piece portion 6 are pushed apart from each other.

The distance between the first side piece portion 5 and the second side piece portion 6 may be formed so as to be narrower toward the projecting direction A. More specifically, as shown in FIG. 4, the spacing L2 between the first side piece portion 5 and the second side piece portion 6 may be shorter than the spacing L1 between the first side piece portion 5 and the second side piece portion 6. In the example shown in FIG. 4, since the degree of curvature of the first side piece portion 5 and the second side piece portion 6 increases toward the projecting direction A, the interval between the first side piece portion 5 and the second side piece portion 6 becomes narrower toward the projecting direction A. The distance between the first side piece portion 5 and the second side piece portion 6 becomes narrower toward the projecting direction A, so that the force that the first side piece portion 5 and the second side piece portion 6 hold the electronic device 200 is increased, and the drop of the electronic device 200 is suppressed.

The first end piece portion 11 and the second end piece portion 13 are formed so as to be spaced apart from each other and opposed to each other in the frame portion 4. More specifically, the first end piece portion 11 is formed on the short side portion 9. The second end piece portion 13 is formed on the short side portion 10. The first end piece portion 11 and the second end piece portion 13 protrude in the projecting direction A away from the frame portion 4. Since the second end piece portion 13 protrudes in the projecting direction A away from the frame portion 4, the drop of the electronic device 200 is suppressed.

A support portion 22 is formed in the first end piece portion 11. The support portion 22 protrudes in a direction away from the second end piece portion 13. A hole 12 is formed in the support portion 22. A fastening needle 2 is passed through the hole 12. The fastening needle 2 preferably protrudes from the end of the first end piece portion 11 in a direction away from the second end piece portion 13. Since the fastening needle 2 protrudes from the end portion of the first end piece portion 11 in a direction away from the second end piece portion 13, the fastening needle 2 does not become an obstacle when the user fits the electronic device 200 into the main body portion 1 or removes the electronic device 200 from the main body portion 1.

The second end piece portion 13 has an inner surface 14 opposite the first end piece portion 11. The inner surface 14 may be formed so as to approach the first end piece portion 11 in the projecting direction A. Since the inner surface 14 is formed so as to approach the first end piece portion 11 toward the projecting direction A, when the electronic device 200 is fitted into the main body portion 1, the electronic device 200 is prevented from slipping in the longitudinal direction C of the second end piece portion 13, and the electronic device 200 is easily guided from the insertion port 3 in the insertion direction D. The insertion direction D is a direction from the insertion port 3 toward the window portion 15. Therefore, since the inner surface 14 is formed so as to approach the first end piece portion 11 toward the projecting direction A, the user can easily fit the electronic device 200 into the main body portion 1.

As shown in FIG. 2, in the projecting direction A, the end portion of the first side piece portion 5, the end portion of the second side piece portion 6, the end portion of the first end piece portion 11, and the end portion of the second end piece portion 13 are preferably located on the imaginary plane E. In the projecting direction A, the end portion of the first side piece portion 5, the end portion of the second side piece portion 6, the end portion of the first end piece portion 11, and the end portion of the second end piece portion 13 are positioned on the imaginary plane E, whereby the projecting direction A of the main body portion 1 on the insertion port 3 side becomes uniform. Therefore, when the main body portion 1 is placed on a desk or the like with the insertion port 3 facing downward, a load is suppressed from being applied to a part of the main body portion 1, and damage to the main body portion 1 is suppressed.

Further, in the projecting direction A, the end portion of the first side piece portion 5, the end portion of the second side piece portion 6, the end portion of the first end piece portion 11, and the end portion of the second end piece portion 13 is located on the imaginary plane E, and in the projecting direction A, the hole 12 is preferably formed at the end portion of the first end piece portion 11. That is, in the projecting direction A, the end portion of the first side piece portion 5, the end portion of the second side piece portion 6, the end portion of the first end piece portion 11, and the end portion of the second end piece portion 13 are located on the imaginary plane E, and the fastening needle 2 is preferably provided at the end portion of the first end piece portion 11 in the projecting direction A. In the projecting direction A, the end portion of the first side piece portion 5, the end portion of the second side piece portion 6, the end portion of the first end piece portion 11, and the end portion of the second end piece portion 13 are located on the imaginary plane E, and the fastening needle 2 is provided at the end portion of the first end piece portion 11 in the projecting direction A, whereby the fixture 100 is fixed in a state along the target part. Therefore, the drop of the electronic device 200 is further suppressed. In addition, even when the fixture 100 is fixed to the target part, the aesthetic appearance of the user carrying the electronic device 200 is not impaired.

A cutout portion 16 may be provided between the first end piece portion 11 and the first side piece portion 5. A cutout portion 17 may be provided between the first side piece portion 5 and the second end piece portion 13. A cutout portion 18 may be provided between the first end piece portion 11 and the second side piece portion 6. A cutout portion 19 may be provided between the second side piece portion 6 and the second end piece portion 13. The outer peripheral surface of the electronic device 200 includes a front surface portion 201, a back surface portion 202 facing the front surface portion 201, and four side surface portions in contact with the front surface portion 201 and the back surface portion 202. Adjacent side portions of the four side portions are connected by a curved surface 203,204,205,206. In the cutout portion 16, the curved surface 203 is exposed. In the cutout portion 17, the curved surface 204 is exposed. In the cutout portion 18, the curved surface 205 is exposed. In the cutout portion 19, the curved surface 206 is exposed.

When the curved surface 203,204,205,206 is exposed in the cutout portions 16, 17, 18, and 19, the user can take in and out the electronic device 200 without applying an excessive force when the electronic device 200 is fitted into the main body portion 1 or when the electronic device 200 is removed from the main body portion 1. Therefore, the electronic device 200 can be easily taken in and out by a user with weak power, such as a child or an elderly person.

When the electronic device 200 is provided with a speaker, the main body portion 1 may be provided with a hole 20 for preventing the speaker from being closed. When the electronic device 200 is provided with an operation button, the window portion 21 may be provided to expose the operation button on the main body portion 1 so that the user can operate the operation button in a state where the electronic device 200 is fitted into the main body portion 1.

As described above, according to the fixture 100 of the first embodiment, the fixture 100 can be fixed to a portion where the fastening needle 2 can be pierced (for example, a portion having a fabric portion such as a hat, clothes, or a bag). Further, according to the fixture 100 of the first embodiment, the insertion port 3 is formed to open toward the target part in a state where the fixture 100 is fixed to the target part. Therefore, when the fixture 100 into which the electronic device 200 is fitted is fixed to the target part, the drop of the electronic device 200 is suppressed by the target part. Therefore, the fixture 100 according to the first embodiment can suppress the target part to which the electronic device 200 can be attached from being limited, and can suppress the electronic device 200 from falling. Therefore, the fixture 100 according to the first embodiment can flexibly cope with the use scene of the electronic device 200 of the user.

Second Embodiment

The fixture 100 according to the first embodiment does not include a lid that covers the insertion port 3. On the other hand, the fixture according to the second embodiment includes a lid that covers at least a part of the insertion port 3. In the second embodiment, differences from the first embodiment will be mainly described.

Figure 5:
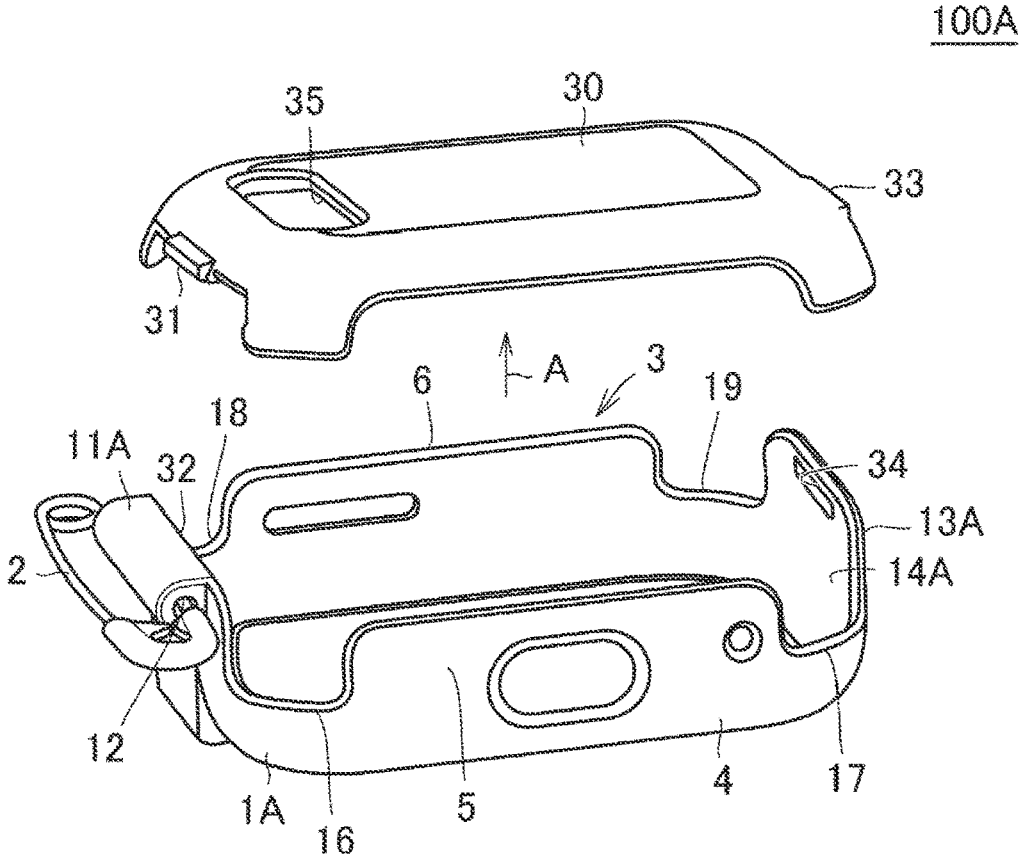
FIG. 5 is a diagram illustrating a fixture of an electronic device according to a second embodiment.

FIG. 5 is a diagram illustrating a fixture of an electronic device according to a second embodiment; The fixture 100A according to the second embodiment includes a frame-shaped main body portion 1A into which the electronic device 200 (see FIG. 1) is fitted, a fastening needle 2 for attaching the main body portion 1A to a target part, and a lid 30. An insertion port 3 into which the electronic device 200 can be inserted is formed in the main body portion 1A. The electronic device 200 is taken in and out from the insertion port 3. When the fixture 100A is fixed to the target part, the insertion port 3 is formed so as to open toward the target part. The lid 30 covers at least a part of the insertion port 3.

The main body portion 1A includes a first end piece portion 11A instead of the first end piece portion 11 and a second end piece portion 13A instead of the second end piece portion 13, but the rest of the configuration is the same as the main body portion 1. The first side piece portion 5, the second side piece portion 6, the first end piece portion 11A, and the second end piece portion 13A define an insertion port 3.

The first end piece portion 11A is provided with a cutout portion 32. The second end piece portion 13A is provided with a cutout portion 34. In a configuration other than the cutout portion 32, the first end piece portion 11A is substantially the same as the first end piece portion 11. In configurations other than the cutout portion 34, the second end piece portion 13A is substantially the same as the second end piece portion 13.

The lid 30 includes a claw 31 and a claw 33. The claw 31 is formed so as to engage with the cutout portion 32. The claw 33 is formed so as to engage with the cutout portion 34. When the claw 31 and the cutout portion 32 are engaged with each other and the claw 33 and the cutout portion 34 are engaged with each other, the main body portion 1A and the lid 30 are engaged with each other, and at least a part of the insertion port 3 is covered with the lid 30. The engagement method between the main body portion 1A and the lid 30 is not limited to the engagement method using the claw and the notch.

The lid 30 may be provided with a window portion 35 through which the charging terminal of the charger of the electronic device 200 can be inserted and removed. Since the lid 30 is provided with the window portions 35 through which the charging terminals of the charger of the electronic device 200 can be inserted and removed, the electronic device 200 does not need to be taken out of the fixture 100A in order to charge the electronic device 200. Therefore, the convenience of the user is improved.

As described above, according to the fixture 100A of the second embodiment, the fixture 100A can be fixed to a part where the fastening needle 2 can be pierced (for example, a part having a fabric part such as a cap, clothes, or a bag). Further, according to the fixture 100A of the second embodiment, at least a part of the insertion port 3 of the main body portion 1A into which the electronic device 200 is fitted is covered with the lid 30. Therefore, according to the fixture 100A of the second embodiment, the drop of the electronic device 200 is suppressed. Therefore, in the fixture 100A according to the second embodiment, it is possible to suppress the target part to which the electronic device 200 can be attached from being limited, and to suppress the electronic device 200 from falling. Therefore, the fixture 100A according to the second embodiment can flexibly cope with the use scene of the electronic device 200 of the user.

Embodiment 3

Figure 6:
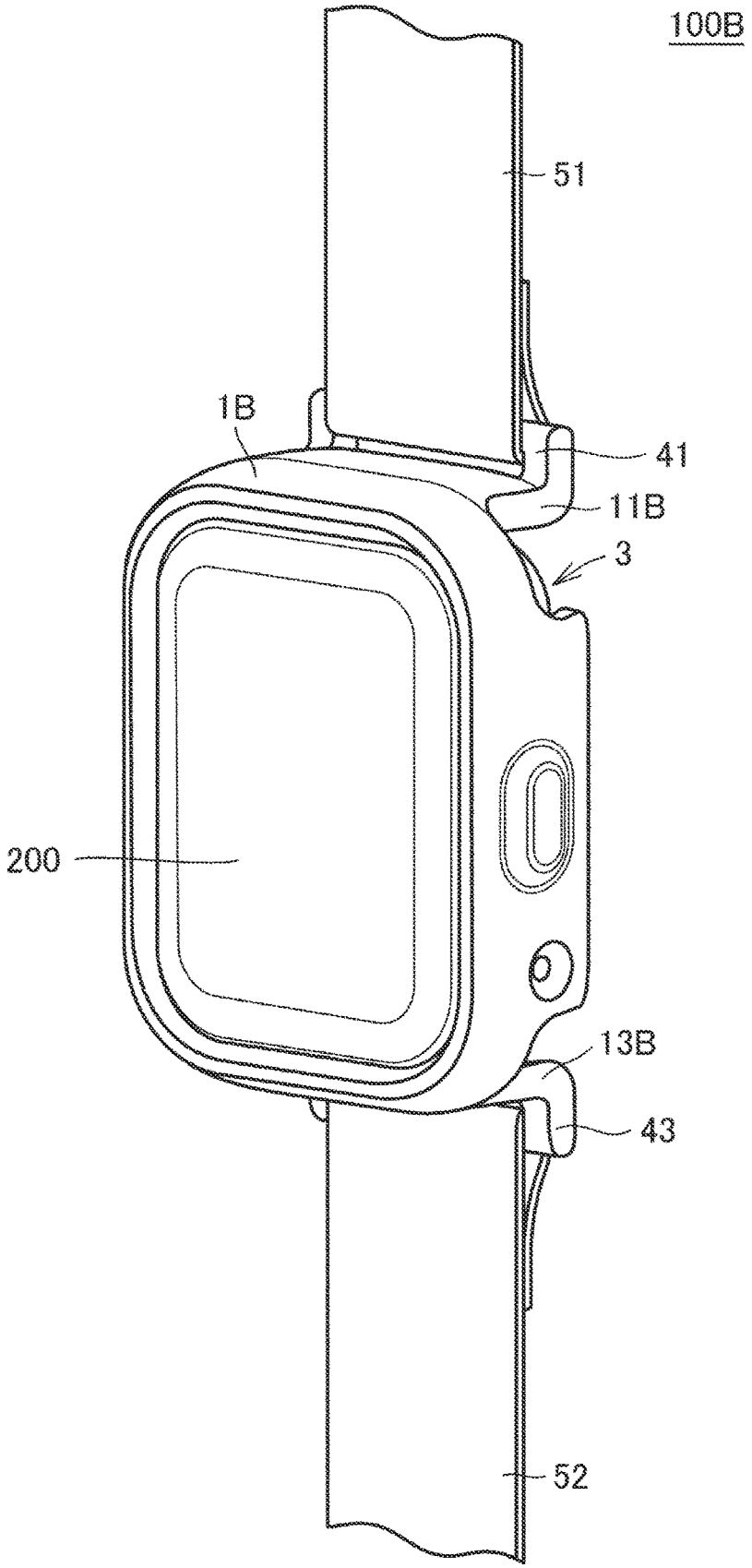
FIG. 6 is a first diagram illustrating a fixture of an electronic device according to the third embodiment.
Figure 7:
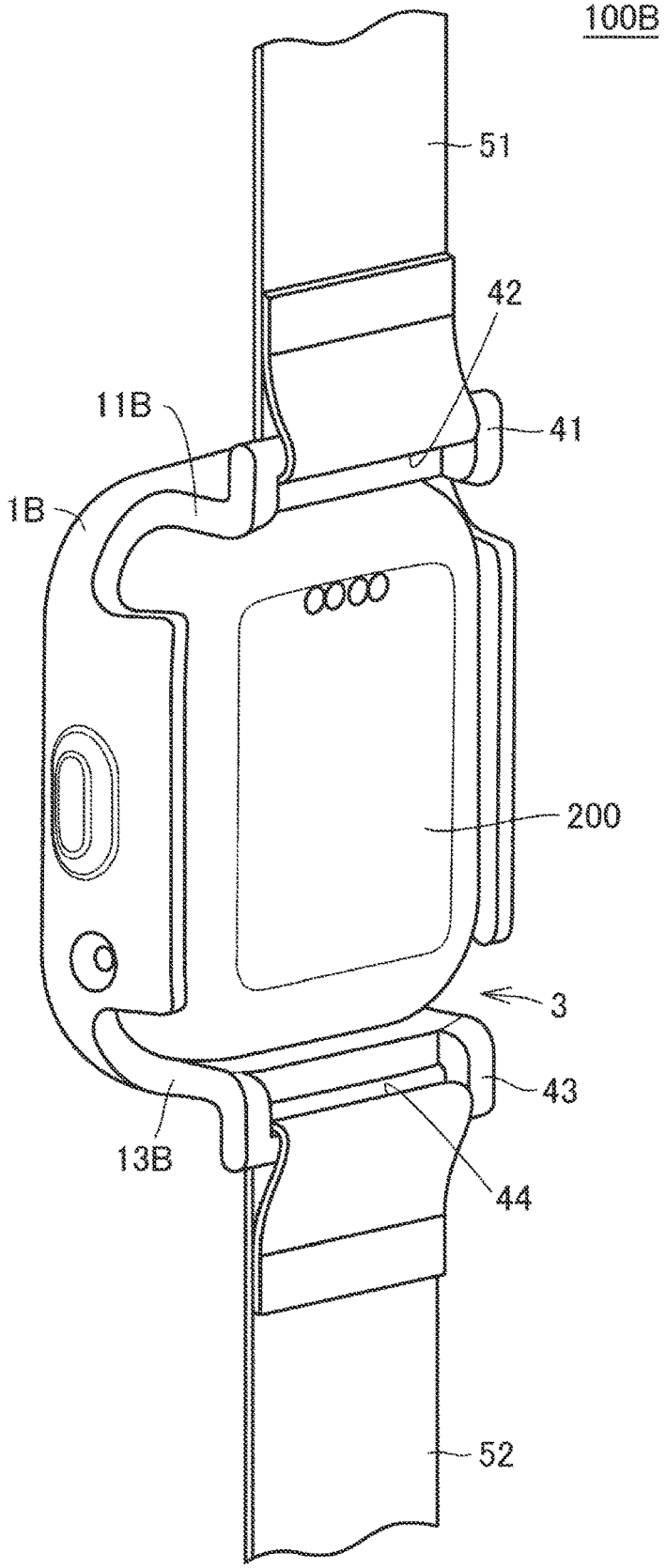
FIG. 7 is a second diagram illustrating a fixture of the electronic device according to the third embodiment.
Figure 8:
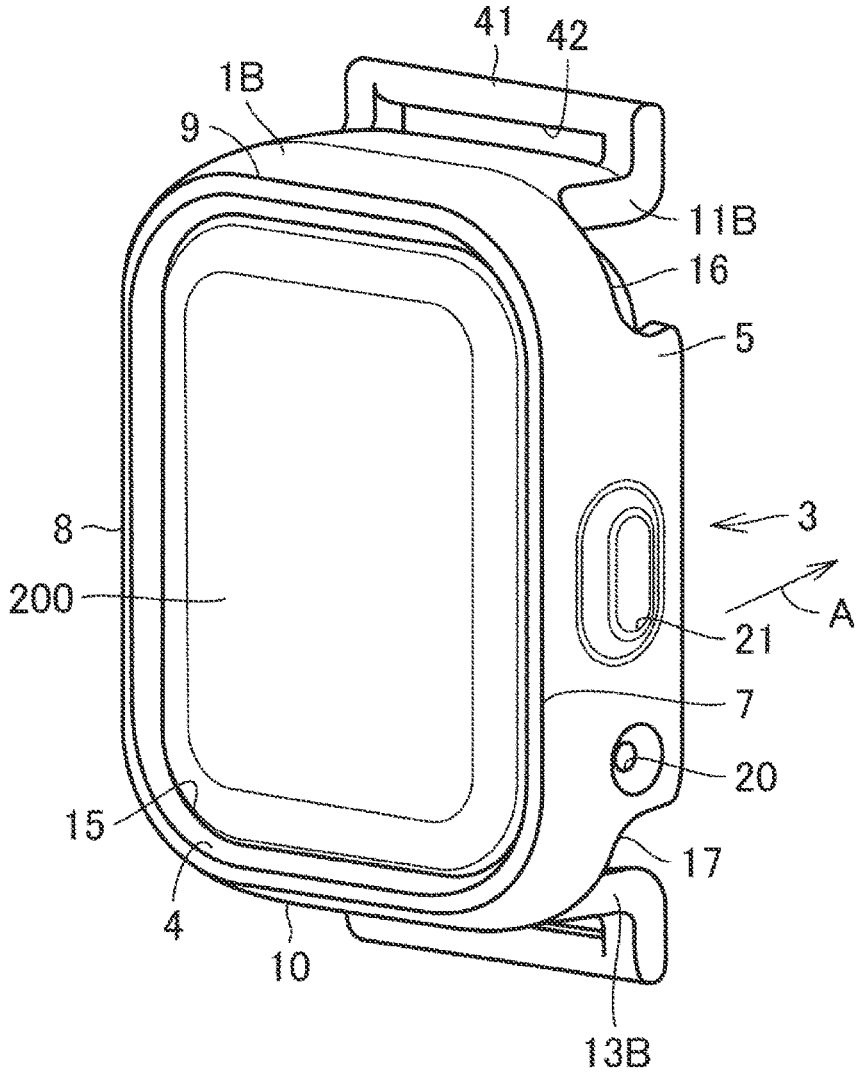
FIG. 8 is a first view illustrating a main body portion of a fixture of the electronic device according to the third embodiment.
Figure 9:
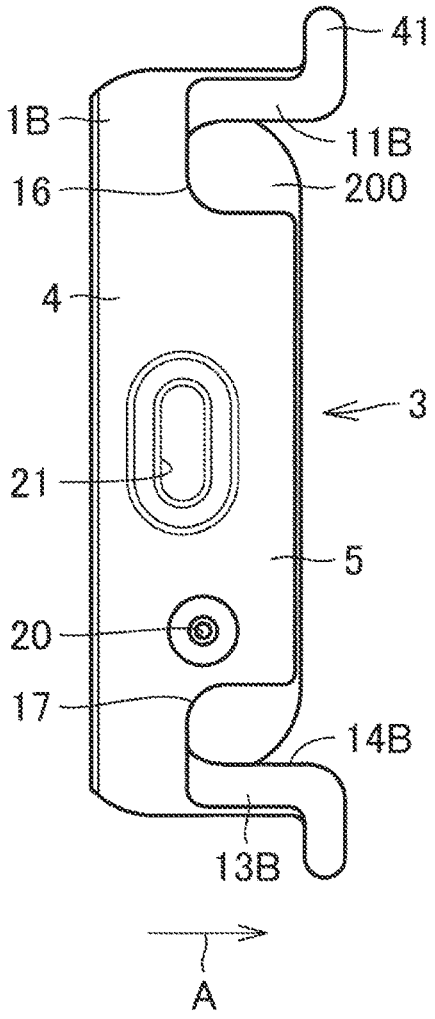
FIG. 9 is a second diagram illustrating a main body portion of a fixture of the electronic device according to the third embodiment.
Figure 10:
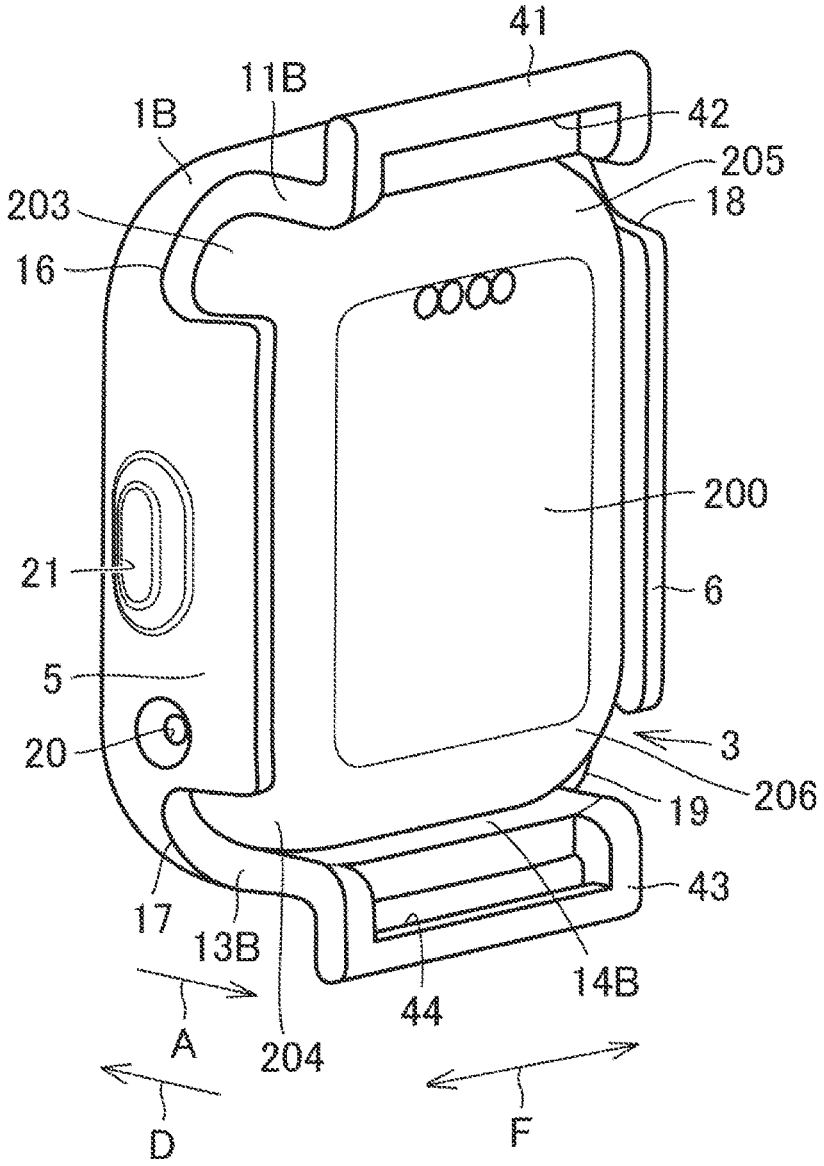
FIG. 10 is a third view showing a main body portion of a fixture of the electronic device according to the third embodiment.

In the first embodiment and the second embodiment, the attachment member is the fastening needle 2, and the target part to which the fixture 100, 100A is attached is, for example, a cap, clothes, or a bag. In contrast, in the third embodiment, the attachment member is a belt, and the target part to which the fixture is attached is a human arm, a human foot, or the like. The third embodiment mainly describes differences from the first embodiment. With reference to FIG. 6 to FIG. 10, a fixture of an electronic device according to a third embodiment will be described. FIG. 6 is a first diagram illustrating a fixture of an electronic device according to a third embodiment; FIG. 7 is a second diagram illustrating a fixture of the electronic device according to the third embodiment; FIG. 8 is a first diagram illustrating a main body portion of a fixture of the electronic device according to the third embodiment; FIG. 9 is a second diagram illustrating a main body portion of a fixture of the electronic device according to the third embodiment; and FIG. 10 is a third diagram illustrating a main body portion of a fixture of the electronic device according to the third embodiment.

Referring to FIGS. 6 and 7, the fixture 100B according to the third embodiment includes a frame-shaped main body portion 1B into which the electronic device 200 is fitted, and belts 51 and 52 for attaching the main body portion 1B to a target part. The belts 51 and 52 are examples of "attachment members" in the present disclosure. By winding the belts 51 and 52 around the target part, the fixture 100B is fixed to the target part. An insertion port 3 into which the electronic device 200 can be inserted is formed in the main body portion 1B. The electronic device 200 is taken in and out from the insertion port 3. When the fixture 100B is fixed to the target part, the insertion port 3 is formed so as to open toward the target part. Therefore, when the fixture 100B into which the electronic device 200 is fitted is fixed to the target part, the drop of the electronic device 200 is suppressed by the target part.

Still referring to FIGS. 8 to 10, the main body portion 1B includes a first end piece portion 11B instead of the first end piece portion 11, and includes a second end piece portion 13B instead of the second end piece portion 13, but the rest of the configuration is the same as the main body portion 1. The first side piece portion 5, the second side piece portion 6, the first end piece portion 11B, and the second end piece portion 13B define an insertion port 3.

The first end piece portion 11B and the second end piece portion 13B are spaced apart from each other and are formed so as to face each other in the frame portion 4. More specifically, the first end piece portion 11B is formed on the short side portion 9. The second end piece portion 13B is formed on the short side portion 10. The first end piece portion 11B and the second end piece portion 13B protrude in the projecting direction A away from the frame portion 4. Since the first end piece portion 11B and the second end piece portion 13B protrude in the projecting direction A away from the frame portion 4, the drop of the electronic device 200 is suppressed.

A frame portion 41 is formed at an end portion of the first end piece portion 11B. The frame portion 41 protrudes away from the end portion of the first end piece portion 11B from the second end piece portion 13B. A belt 51 (see FIGS. 6 and 7) passes through the insertion port 42 defined by the frame portion 41. Since the frame portion 41 protrudes away from the end portion on the first end piece portion 11B from the second end piece portion 13B, the user can easily fit the electronic device 200 into the main body portion 1B or remove the electronic device 200 from the main body portion 1B.

A frame portion 43 is formed at an end portion of the second end piece portion 13B. The frame portion 43 protrudes away from the end portion of the second end piece portion 13B from the first end piece portion 11B. A belt 52 (see FIGS. 6 and 7) passes through the insertion port 44 defined by the frame portion 43. Since the frame portion 43 protrudes away from the end portion on the second end piece portion 13B from the first end piece portion 11B, the user can easily fit the electronic device 200 into the main body portion 1B or remove the electronic device 200 from the main body portion 1B.

In FIG. 10, the second end piece portion 13B has an inner surface 14B opposite the first end piece portion 11B. The inner surface 14B may be formed so as to approach the first end piece portion 11B toward the projecting direction A. Since the inner surface 14B is formed so as to approach the first end piece portion 11B toward the projecting direction A, when the electronic device 200 is fitted into the main body portion 1B, the electronic device 200 is prevented from slipping in the longitudinal direction F of the second end piece portion 13B, and the electronic device 200 is easily guided from the insertion port 3 in the insertion direction D. Therefore, since the inner surface 14B is formed so as to approach the first end piece portion 11B toward the projecting direction A, the user can easily fit the electronic device 200 into the main body portion 1B.

Further, the insertion port 42 is formed at the end of the first end piece portion 11B in the projecting direction A, and the insertion port 44 is preferably formed at the end of the second end piece portion 13B in the projecting direction A. That is, it is preferable that the belt 51 is provided at an end portion on the first end piece portion 11B in the projecting direction A, and the belt 52 is provided at an end portion on the second end piece portion 13B in the projecting direction A. The belt 51 is provided at an end portion on the first end piece portion 11B in the projecting direction A, and the belt 52 is provided at an end portion on the second end piece portion 13B in the projecting direction A, whereby the fixture 100B is fixed along the target part. Therefore, the drop of the electronic device 200 is further suppressed. In addition, even when the fixture 100B is fixed to the target part, the aesthetic appearance of the user carrying the electronic device 200 is not impaired.

A cutout portion 16 may be provided between the first end piece portion 11B and the first side piece portion 5. A cutout portion 17 may be provided between the first side piece portion 5 and the second end piece portion 13B. A cutout portion 18 may be provided between the first end piece portion 11B and the second side piece portion 6. A cutout portion 19 may be provided between the second side piece portion 6 and the second end piece portion 13B. In the cutout portion 16, the curved surface 203 is exposed. In the cutout portion 17, the curved surface 204 is exposed. In the cutout portion 18, the curved surface 205 is exposed. In the cutout portion 19, the curved surface 206 is exposed.

When the curved surface 203,204,205,206 is exposed in the cutout portions 16, 17, 18, and 19, the user can take in and out the electronic device 200 without applying an excessive force when the electronic device 200 is fitted to the main body portion 1B or when the electronic device 200 is removed from the main body portion 1B. Therefore, the electronic device 200 can be easily taken in and out by a user with weak power, such as a child or an elderly person.

As described above, according to the fixture 100B of the third embodiment, the fixture 100B can be fixed to the part where the belts 51 and 52 can be wound (for example, a human arm or a human foot). Further, according to the fixture 100B of the third embodiment, when the fixture 100B is fixed to the target part, the insertion port 3 is formed so as to open toward the target part. Therefore, when the fixture 100B into which the electronic device 200 is fitted is fixed to the target part, the drop of the electronic device 200 is suppressed by the target part. Therefore, in the fixture 100B according to the third embodiment, it is possible to suppress the target part to which the electronic device 200 can be attached from being limited, and to suppress the electronic device 200 from falling. Therefore, the fixture 100B according to the third embodiment can flexibly cope with the use scene of the electronic device 200 of the user.

Further, in the fixture 100B according to the third embodiment, the attachment member is composed of two belts (the belt 51 and the belt 52). Therefore, since the insertion port 3 of the main body portion 1B is not covered with the belt, the user can easily take the electronic device 200 in and out.

Figure 11:
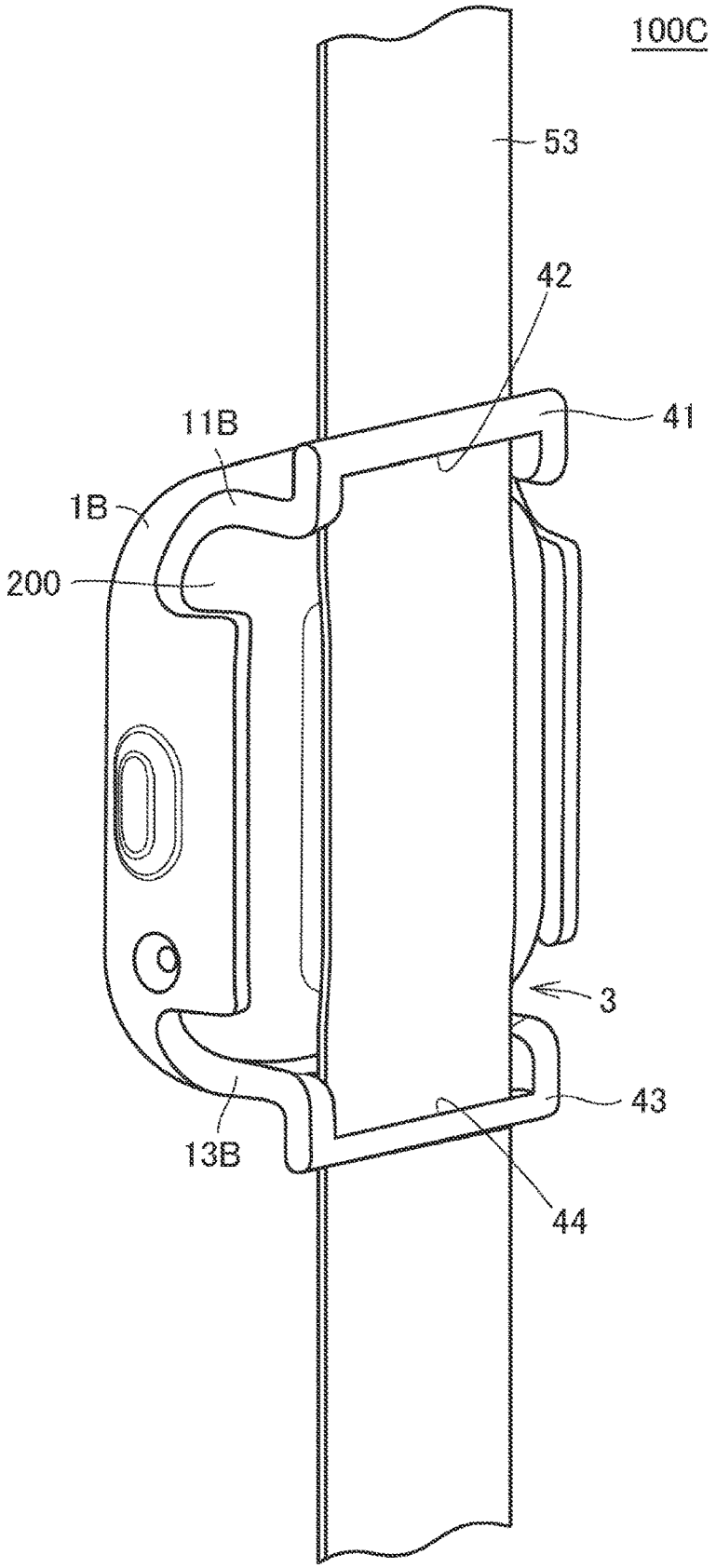
FIG. 11 is a diagram illustrating a modification of the fixture of the electronic device according to Embodiment 3.

As in the fixture 100C shown in FIG. 11, the attachment member may be a single strap. FIG. 11 is a diagram illustrating a modification of the fixture of the electronic device according to the third embodiment. The fixture 100C includes a belt 53 instead of the belt 51 and the belt 52 as attachment members. The fixture 100C is otherwise the same as the fixture 100B. The belt 53 passes through the insertion port 42 and the insertion port 44. By winding the belt 53 around the target part, the fixture 100C is fixed to the target part.

According to the fixture 100C, when the fixture 100C is fixed to the target part, the insertion port 3 is formed so as to open toward the target part. At least a part of the insertion port 3 of the main body portion 1B is covered with a belt 53. Therefore, when the fixture 100C into which the electronic device 200 is fitted is fixed to the target part, the drop of the electronic device 200 is suppressed by the target part and the belt 53.

The embodiment disclosed herein should be considered to be exemplary and not restrictive in all respects. It is intended that the scope of the disclosure be defined by the appended claims rather than the foregoing description, and that all changes within the meaning and range of equivalency of the claims be embraced therein.

What is claimed is:

1. A fixture for an electronic device comprising:

a frame-shaped body into which the electronic device is to be fitted; and an attachment member configured to attach the frame-shaped body to a target part, wherein the frame-shaped body includes an insertion port into which the electronic device is insertable, the insertion port being open to the target part in a state in which the fixture is fixed to the target part, a frame with rounded corners, and a first side piece and a second side piece provided away from each other on the frame and facing each other, the first side piece and the second side piece projecting in a projecting direction away from the frame such that a distance between the first side piece and the second side piece decreases in the projecting direction, the frame includes a pair of long side portions and a pair of short side portions, the frame-shaped body further includes a first end piece provided on one of the short side portions, and a second end piece provided on the other of the short side portions and facing the first end piece, the first side piece is provided on one of the long side portions, the second side piece is provided on the other of the long side portions, the first end piece and the second end piece project in the projecting direction, and in the projecting direction, an end of the first side piece, an end of the second side piece, an end of the first end piece, and an end of the second end piece are positioned on a virtual plane.

2. The fixture according to claim 1, wherein the attachment member is provided at the end of the first end piece in the projecting direction, and projects from the end of the first end piece away from the second end piece.

3. The fixture according to claim 2, wherein:

the second end piece includes an inner surface facing the first end piece; and the inner surface is provided closer to the first end piece in the projecting direction.

* * * * *